US008284221B2

(12) United States Patent
Taguchi

(10) Patent No.: US 8,284,221 B2
(45) Date of Patent: Oct. 9, 2012

(54) ERASING DEVICE, IMAGE FORMING APPARATUS, AND ERASING METHOD

(75) Inventor: Hiroyuki Taguchi, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 337 days.

(21) Appl. No.: 12/774,411

(22) Filed: May 5, 2010

(65) Prior Publication Data

US 2010/0289861 A1 Nov. 18, 2010

Related U.S. Application Data

(60) Provisional application No. 61/178,431, filed on May 14, 2009.

(51) Int. Cl.
*B41J 29/16* (2006.01)

(52) U.S. Cl. ..... 347/179

(58) Field of Classification Search ..... 347/179, 347/171–174, 104, 105, 131, 223, 229, 233, 347/234, 248; 399/4, 186–188; 250/316.1, 250/317.1

See application file for complete search history.

(56) References Cited

U.S. PATENT DOCUMENTS

| | | | | |
|---|---|---|---|---|
| 5,333,039 | A * | 7/1994 | Sagara | 399/4 |
| 5,436,643 | A * | 7/1995 | Yamaguchi et al. | 347/179 |
| 5,537,135 | A * | 7/1996 | Hevenor et al. | 347/171 |
| 2010/0321456 | A1 * | 12/2010 | Tsuchihashi et al. | 347/179 |

FOREIGN PATENT DOCUMENTS

JP 06-270431 9/1994

* cited by examiner

*Primary Examiner* — Kristal Feggins
(74) *Attorney, Agent, or Firm* — Patterson & Sheridan, LLP

(57) ABSTRACT

An erasing device includes a line scanner on an upstream side in a recording medium conveying direction, includes a thermal head downstream in the recording medium conveying direction of the line scanner, and includes a platen in a position opposed to the thermal head as a heating device across a recording medium conveying path. The erasing device causes the heat generating elements of the thermal head in positions corresponding to color and density sensors in positions of an image detected by the line scanner to generate heat. The erasing device controls, according to detected colors or density, a quantity of heat to be generated.

20 Claims, 7 Drawing Sheets

ERASING DEVICE, IMAGE FORMING APPARATUS, AND ERASING METHOD

CROSS-REFERENCE TO RELATED APPLICATIONS

This application is based upon and claims the benefit of priority from the prior the U.S. Patent Application No. 61/178431, filed on May 14, 2009, the entire contents of which are incorporated herein by reference.

TECHNICAL FIELD

The present invention relates to an image forming apparatus, an erasing device, and an erasing method that can erase an image formed on a recording medium.

BACKGROUND

In recent years, an erasing device is introduced according to a demand for saving of resources. The erasing device applies heat or light to a recording medium on which an image is formed with an erasable developing agent and erases the developing agent to thereby erase the image. Therefore, the recording medium after the erasing can be reused.

However, the erasing device in the past applies heat or light to the entire recording medium. Therefore, energy is wastefully consumed and deterioration of the recording medium is accelerated.

As a measure against this problem, there is proposed a technique for reading a recording medium on which an image is formed by a scan unit, calculating, from read data, a position where the image is formed, heating, with a thermal head, a section where the image is formed and irradiating light on the section to erase the image (see, for example, JP-A-6-270431).

However, with this technique, since the light is irradiated on a wide section of the recording medium, energy is still wastefully consumed and deterioration of the recording medium is still fast.

SUMMARY

It is an object of the present invention to provide an erasing device that can suppress wasteful consumption of energy.

In an aspect of the present invention, there is provided an erasing device configured to erase an image formed on a recording medium, the erasing device including:

a line scanner configured to read an image formed on a recording medium conveyed thereto;

a thermal head set downstream in a recording medium conveying direction of the line scanner and on the same side as the line scanner with respect to a conveying path for the recording medium and including plural heat generating elements; and an erasing-device control section configured to change, according to an output of the line scanner, positions of the heat generating elements to be caused to generate heat and a quantity of heat of each of the heat generating elements.

DETAILED DESCRIPTION

An erasing device, an image forming apparatus, and an erasing method according to an embodiment of the present invention are explained in detail below with reference to the accompanying drawings. The image forming apparatus is a copying machine, a MFP (Multifunction Peripheral), or a printer.

Configuration of an Image Forming Apparatus

Figure 1:
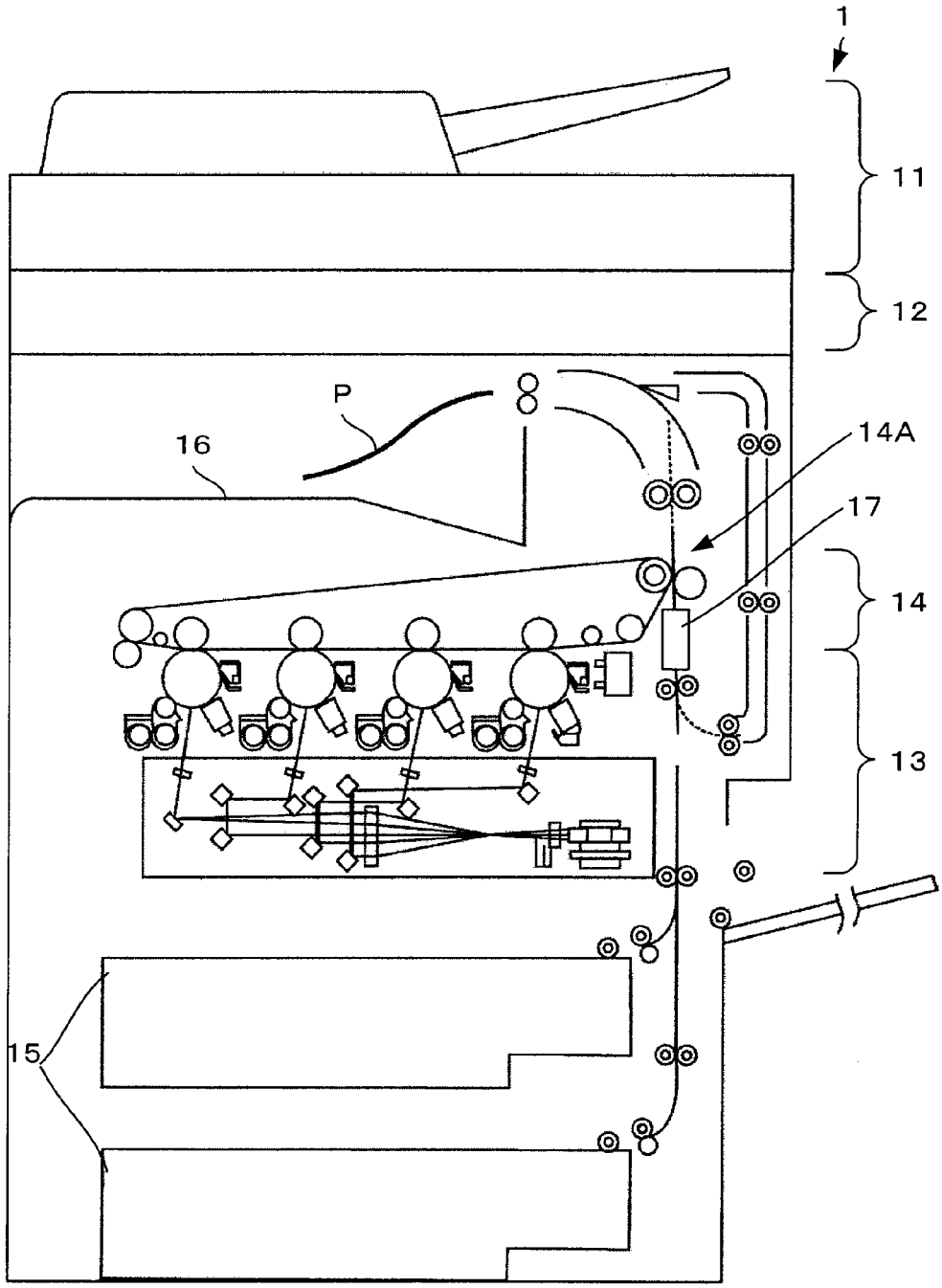
FIG. 1 is a diagram of the configuration of an image forming apparatus according to the present invention.

FIG. 1 is a diagram of the configuration of an image forming apparatus 1 according to this embodiment. As shown in FIG. 1, the image forming apparatus 1 includes an auto document feeder 11, an image reading section 12, an image forming section 13, a transfer section 14, a sheet conveying mechanism, a paper feeding unit 15, and an erasing device 17.

The auto document feeder 11 is openably and closably set in an upper part of a main body of the image forming apparatus 1. The auto document feeder 11 includes a document conveying mechanism configured to extract original documents from a paper feeding tray one by one and convey the original document to a paper discharge tray.

The auto document feeder 11 conveys, with the document conveying mechanism, the original documents to a document reading section of the image reading section 12 one by one. It is also possible to open the auto document feeder 11 and place an original document on a document table of the image reading section 12.

The image reading section 12 includes a carriage including an exposure lamp configured to expose an original document to light and a first reflection mirror, plural second reflection mirrors set on a main body frame of the image forming apparatus 1, a lens block, and a CCD (Charge Coupled Device) of an image reading sensor.

The carriage stands still in the document reading section or reciprocatingly moves under the document table to reflect the light of the exposure lamp, which is reflected by the original document, to the first reflection mirror. The plural second reflection mirrors reflect the reflected light of the first reflection mirror to the lens block. The lens block magnifies the reflected light and outputs the reflected light to the CCD. The CCD converts the light made incident thereon into an electric signal and outputs the incident light to the image forming section 13 as an image signal.

The image forming section 13 includes a laser irradiating unit, a photoconductive drum as an electrostatic latent image bearing member, and a developing-agent supplying unit.

The laser irradiating unit irradiates a laser beam on the photoconductive drum on the basis of the image signal and forms an electrostatic latent image on the photoconductive drum. The developing-agent supplying unit supplies a developing agent to the. photoconductive drum and forms a developing agent image from the electrostatic latent image.

The paper feeding unit 15 extracts recording media from paper feeding cassettes one by one and passes the recording medium to the sheet conveying mechanism. The sheet conveying mechanism conveys the recording medium to the transfer section 14.

The transfer section 14 includes a transfer belt, a transfer roller, and a fixing device 14A. The transfer belt as an image bearing member receives transfer of the developing agent image on the photoconductive drum and bears the developing agent image. The transfer roller is applied with voltage and transfers the developing agent image on the transfer belt onto the recording medium conveyed thereto. The fixing device 14A heats and presses the developing agent image and fixes the developing agent image on the recording medium.

The erasing device 17 is set in a recording medium conveying path upstream in a recording medium conveying direction of the fixing device 14A of the transfer section 14. As explained later, the erasing device 17 erases an image on a recording medium P, which passes the inside of the erasing device 17, by erasing a developing agent. Therefore, the transfer section 14 can transfer the developing agent to the erased recording medium and fix the developing agent thereon.

The recording medium P discharged from a discharge port is stacked on a paper discharge tray 16 as a storing section configured to store recording media.

Figure 2:
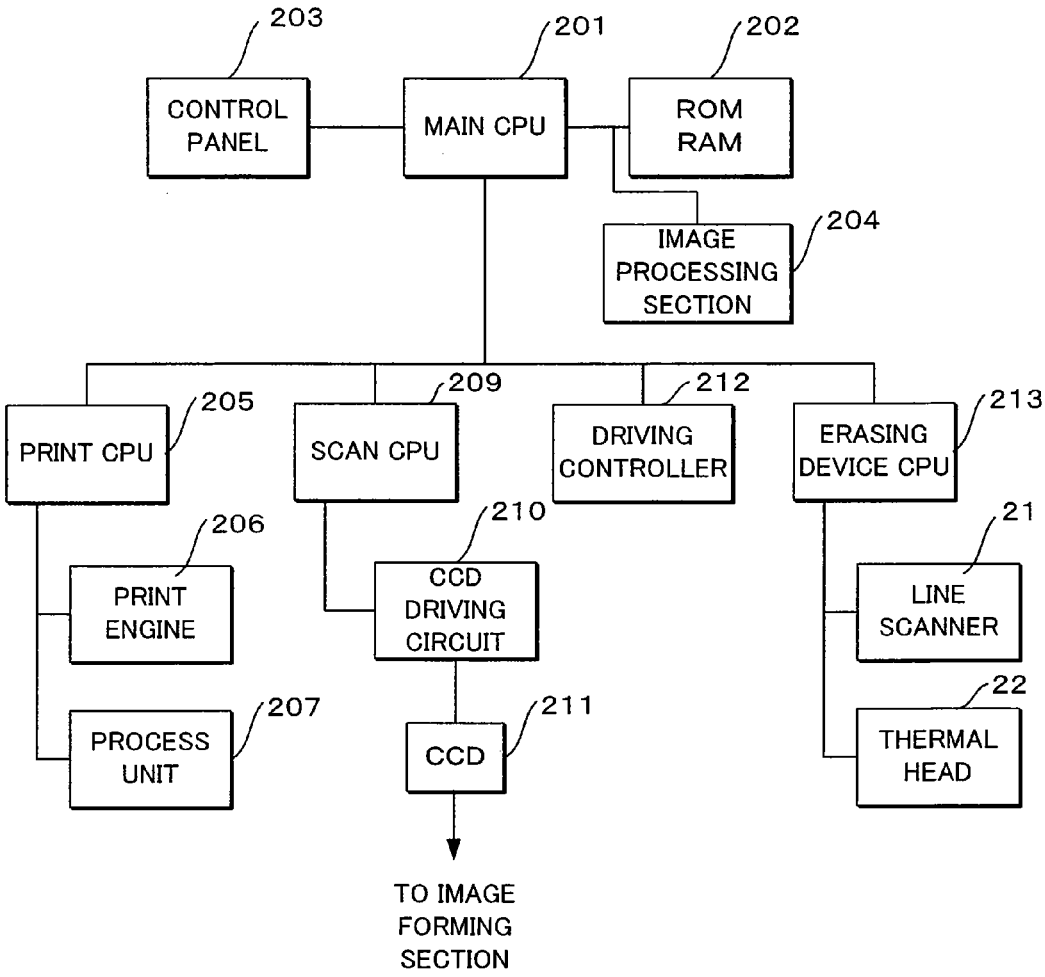
FIG. 2 is a schematic diagram of the configuration of the image forming apparatus according to the present invention.

FIG. 2 is a schematic diagram of the configuration of the image forming apparatus 1. As shown in FIG. 2, the image forming apparatus 1 includes a main CPU 201 as an arithmetic device configured to collectively control the entire image forming apparatus 1, a control panel 203 connected to the main CPU 201, a ROM and RAM 202 as a storage device, and an image processing section 204 configured to perform image processing.

The main CPU 201 is connected to a print CPU 205 configured to control sections of an image forming system, a scan CPU 209 configured to control sections of an image reading system, a driving controller 212 configured to control a driving section, and an erasing device CPU 213 as an erasing-device control section configured to control the erasing device 17.

The print CPU 205 controls a print engine 206 configured to form an electrostatic latent image on a photoconductive drum body and a process unit 207 configured to form a developing agent image.

The scan CPU 209 controls a CCD driving circuit 210 configured to drive a CCD 211. A signal from the CCD 211 is output to the image forming section 13.

The erasing device CPU 213 is connected to a line scanner 21 set in the erasing device 17 and a thermal head 22 set downstream in the recording medium conveying direction of the line scanner 21.

The erasing device CPU 213 receives the input of a scan output as an output from the line scanner 21 and drives the thermal head 22 on the basis of the scan output.

The erasing device 17 may include a storage device such as an FIFO memory configured to temporarily store the scan output. When the storage device is set, the erasing device CPU 213 is connected to the storage device.

Figure 3:
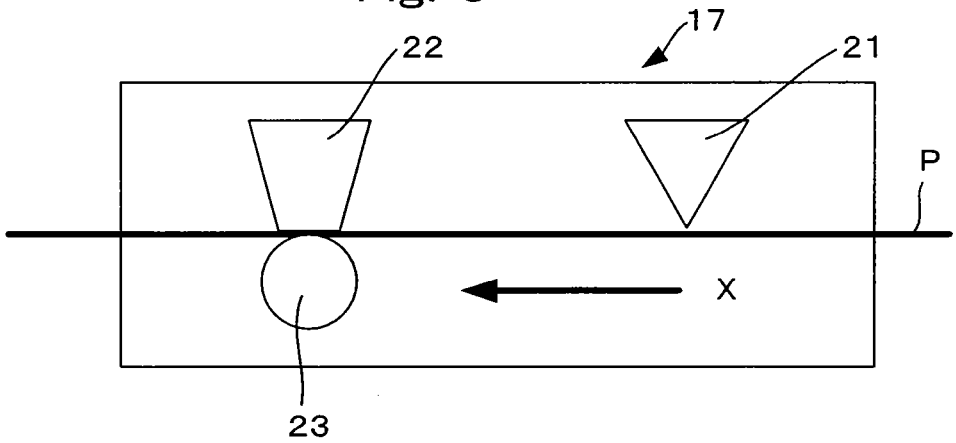
FIG. 3 is a side block diagram of the configuration of an erasing device according to the present invention.

FIG. 3 is a side block diagram of the configuration of the erasing device 17. As shown in FIG. 3, the erasing device 17 includes a line scanner 21 on the upstream side in the recording medium conveying direction indicated by an arrow X. The erasing device 17 includes a thermal head 22 downstream in the recording medium conveying direction of the line scanner 21 and includes a platen 23 in a position opposed to the thermal head 22 as a heating device across the recording medium conveying path on which the recording medium P is conveyed.

The line scanner 21 and the thermal head 22 are set on the same side with respect to the recording medium conveying path on which the recording medium P is conveyed.

The platen 23 is a roller having axial length substantially the same as the length in a recording medium width direction of the thermal head 22. The platen 23 presses the recording medium P against the thermal head 22.

Figure 4:
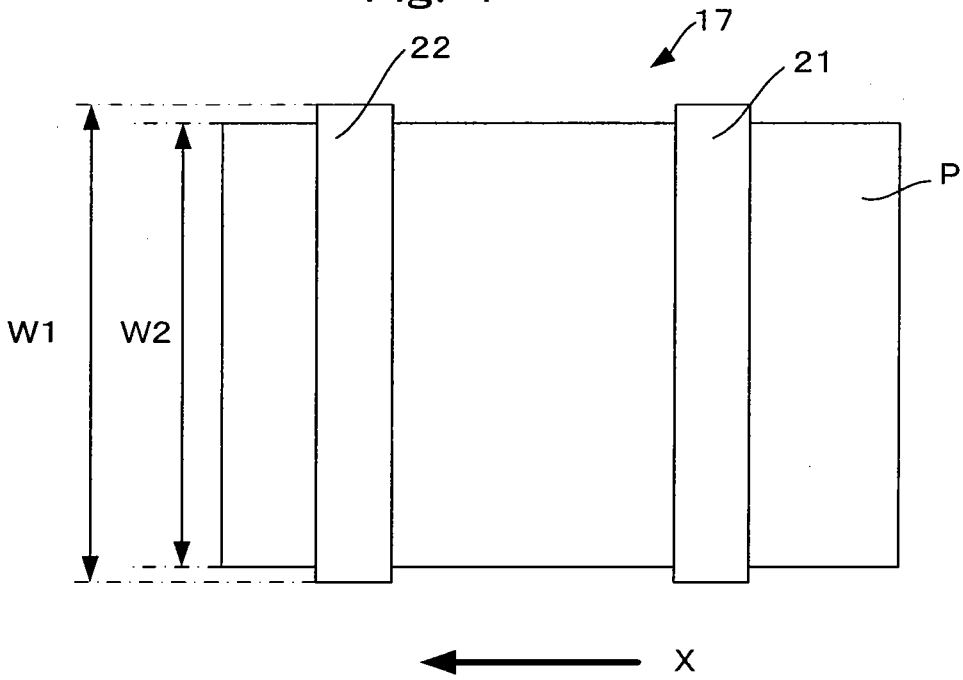
FIG. 4 is a plan view of the inside of the erasing device according to the present invention.

FIG. 4 is a plan view of the inside of the erasing device 17. The line scanner 21 and the thermal head 22 are set to be orthogonal to the recording medium conveying direction indicated by the arrow X.

Length W1 in the recording medium width direction of the line scanner 21 and the thermal head 22 is equal to or larger than width W2 of the recording medium P.

Figure 5:
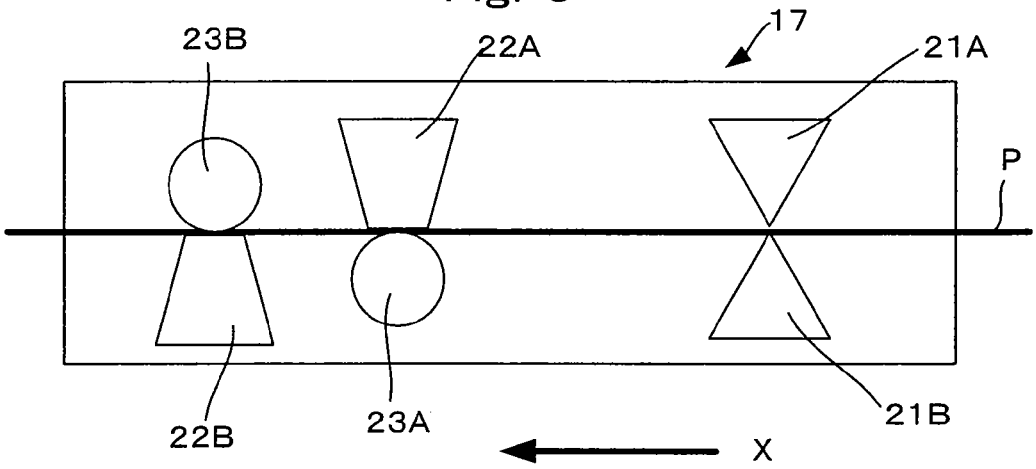
FIG. 5 is a side block diagram of the configuration of the erasing device that can perform both-side erasing according to the present invention.

FIG. 5 is a side block diagram of the configuration of the erasing device 17 that can perform both-side erasing. As shown in FIG. 5, the erasing device 17 includes a first line scanner 21A on the upstream side in the recording medium conveying direction indicated by the arrow X. The erasing device 17 includes a second line scanner 21B in a position opposed to the first line scanner 21A across the recording medium conveying path. Therefore, the erasing device 17 can scan both sides of the recording medium P.

The erasing device 17 includes a first thermal head 22A downstream in the recording medium conveying direction of the first line scanner 21A and the second line scanner 21B and includes a first platen 23A in a position opposed to the first thermal head 22A across the recording medium conveying path.

Further, the erasing device 17 includes a second thermal head 22B downstream in the recording medium conveying direction of the first thermal head 22A and the first platen 23A and includes a second platen 23B in a position opposed to the second thermal head 22B across the recording medium conveying path.

The second thermal head 22B is set on the opposite side of the first thermal head 22A across the recording medium conveying path. Therefore, when the thermal head 22A heats the front side of the recording medium P, the thermal head 22B heats the rear side of the recording medium P.

Figure 6:
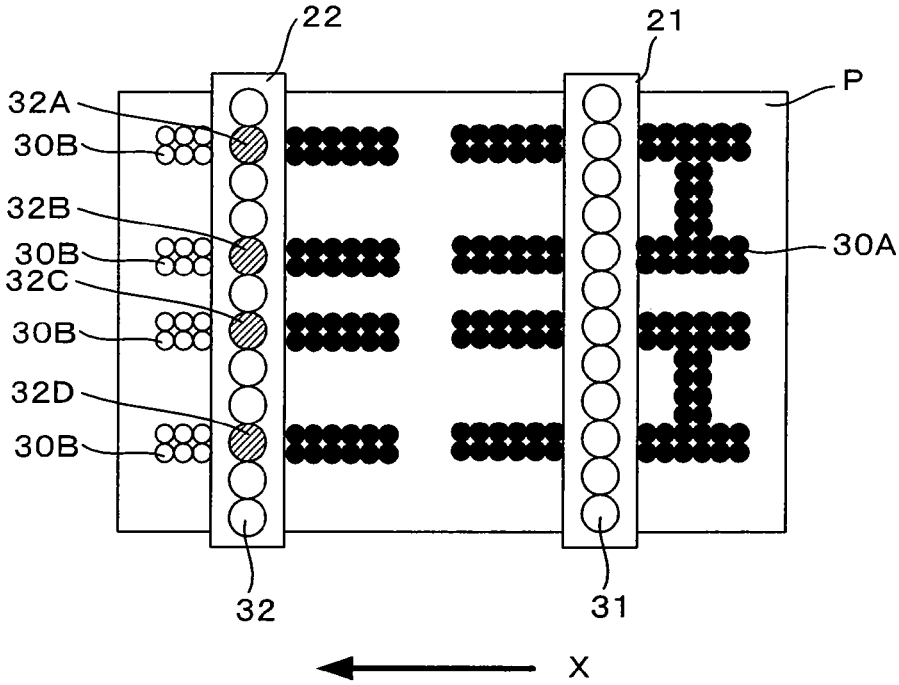
FIG. 6 is a diagram of a state of erasing by the erasing device according to the present invention.

FIG. 6 is a diagram of a state of erasing by the erasing device 17. As shown in FIG. 6, an image 30A is formed on the recording medium P with a developing agent erasable by heat.

As the developing agent erasable by heat, a publicly-known developing agent can be used. For example, a developing agent containing a matrix material, a developer, a color-assuming compound, and a decolorizer can be used. The developing agent is erased when the developer and the decolorizer are combined by heat. Among developing agents of this type, a developing agent that is erased within 0.5 seconds after heating is suitable.

The erasing device 17 selectively executes a point erasing mode and a full-screen erasing mode explained later. The point erasing mode and the full-screen erasing mode are selected by a user.

Point Erasing Mode

The erasing device 17 causes heat generating elements 32 of the thermal head 22 in positions corresponding to color and density sensors 31 in positions of colors detected by the line scanner 21 to generate heat. Therefore, only small amount of energy is required for erasing.

The line scanner 21 includes the plural full-color color and density sensors 31 on a straight line perpendicular to the recording medium conveying direction X. The line scanner 21 scans colors and density of an image on a recording medium conveyed thereto and outputs the colors and the density to the erasing device CPU 213.

The scan output is temporarily stored in a storage device such as an FIFO memory for each of the color and density sensors 31.

The thermal head 22 includes the plural heat generating elements 32 on a straight line perpendicular to the recording medium conveying direction X. The heat generating elements 32 are arranged in positions corresponding to the color and density sensors 31 in the direction perpendicular to the recording medium conveying direction X.

The erasing device CPU 213 reads out the scan output from the storage device line by line and causes the heat generating elements 32 of the thermal head 22 in positions corresponding colors detected by the color and density sensors 31 to generate heat. In an example shown in FIG. 6, heat generating elements 32A to 32D generate heat and the other heat generating elements do not generate heat. As a result, the image 30A is erased and changes to a colorless transparent image 30B.

Full-Screen Erasing Mode

The erasing device 17 can also force all the heat generating elements to operate to generate heat. There is an advantage that processing is faster in the full-screen erasing mode when an image is formed over the entire recording medium P.

Figure 7:
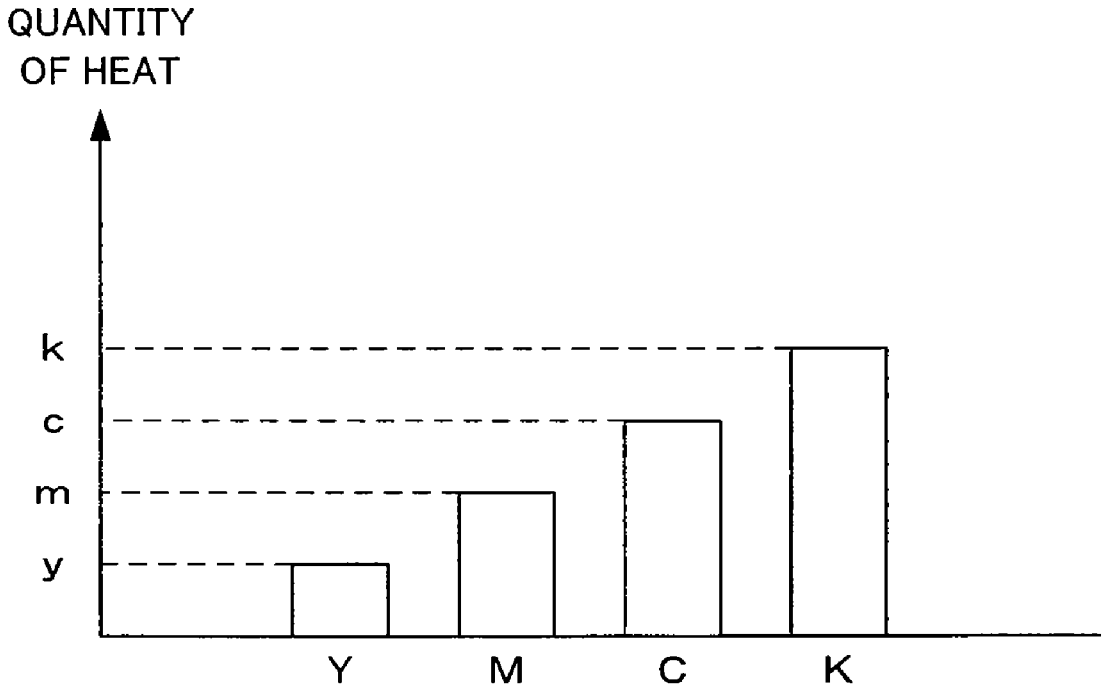
FIG. 7 is a graph of a quantity of heat necessary for erasing each of color developing agents.

FIG. 7 is a graph of a quantity of heat necessary for erasing each of color developing agents. As shown in FIG. 7, a quantity of heat necessary for erasing is different depending on a color of a developing agent. It is assumed that y Cal, m Cal, c Cal, and k Cal are respectively necessary for erasing a developing agent of yellow Y, a developing agent of magenta M, a developing agent of cyan C, and developing agent of black K.

A color Dn detected by an nth color and density sensor 31 is represented by a matrix as indicated by the following Formula (1):

$$Dn=(\Delta_Y, \Delta_M, \Delta_C, \Delta_K) \quad (1)$$

It is assumed that, when a color i is detected, $\Delta_i$ is 1 and, when the color i is not detected, $\Delta_i$ is 0.

A quantity of heat H generated by an nth heat generating element 32 is as indicated by the following Formula (2):

$$Hn=\mathrm{MAX}(\Delta_Y y, \Delta_M m, \Delta_C c, \Delta_K k) \quad (2)$$

It is assumed that MAX (a, b, c, d) is a function that returns a largest value among a, b, c, and d.

For example, in the case of green, the color Dn is represented as Dn=(1, 0, 1, 0). Therefore, the quantity of heat Hn is represented as Hn=MAX(y, 0, c, 0)=c.

Therefore, it is possible to erase the color without wastefully consuming heat.

$\Delta_i$ can also be represented by a gradation in such a manner that, when density is the highest, $\Delta_i$ is 1 and, when density is not detected, $\Delta_i$ is 0.

Figure 8:
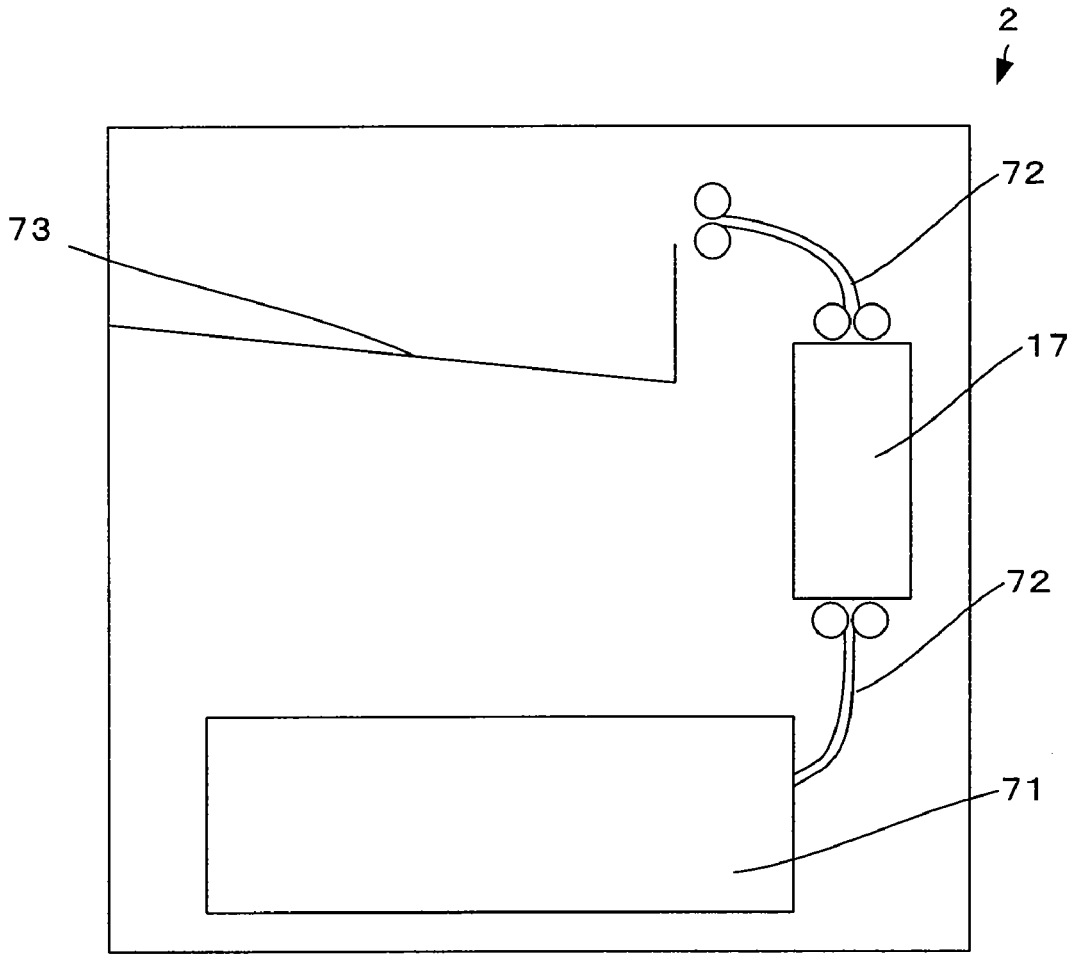
FIG. 8 is a diagram of the configuration of an image erasing device exclusively used for erasing according to the present invention.

In this case, it is possible to control heat generating elements to generate more heat when a color is dense and generate less heat when a color is thin. FIG. 8 is a diagram of the configuration of an image erasing device 2 exclusively used for erasing. As shown in FIG. 8, the image erasing device 2 includes a recording-medium accumulating section 71 configured to accumulate recording media on which images are formed with an erasable developing agent, a recording-medium conveying mechanism 72 configured to extract the recording media from the recording-medium accumulating section 71 one by one and convey the recording medium, the erasing device 17, and a paper discharge tray 73 on which an erased recording medium is stacked.

Figure 9:
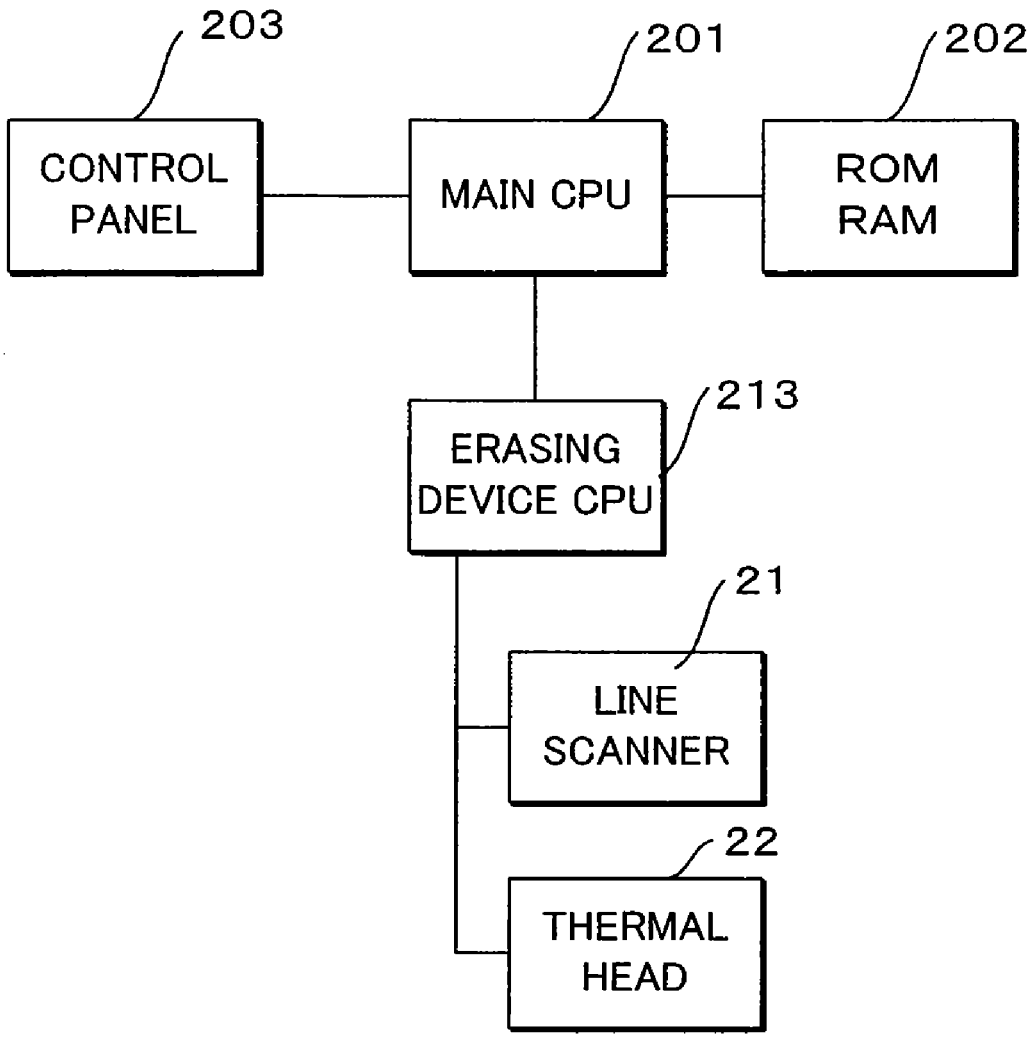
FIG. 9 is a schematic diagram of the configuration of the image erasing device according to the present invention.

FIG. 9 is a schematic diagram of the configuration of the image erasing device 2. As shown in FIG. 9, the image erasing device 2 includes a main CPU 201 as an arithmetic device configured to collectively control the entire image erasing device 2, a control panel 203 connected to the main CPU 201, and a ROM and RAM 202 as a storage device.

The main CPU 201 is connected to the erasing device CPU 213 configured to control the erasing device 17. The erasing device CPU 213 is connected to the line scanner 21 set in the erasing device 17 and the thermal head 22 set downstream in the recording medium conveying direction of the line scanner 21.

The erasing device CPU 213 receives the input of a scan output from the line scanner 21 and drives the thermal head 22 on the basis of the scan output.

The erasing device 17 may include a storage device such as an FIFO memory configured to temporarily store the scan output. When the storage device is set, the erasing device CPU 213 is connected to the storage device.

The configuration and the operation of the erasing device 17 are the same as those in the image forming apparatus 1.

As explained above, the erasing device 17 according to this embodiment includes the line scanner 21 on the upstream side in the recording medium conveying direction, includes the thermal head 22 downstream in the recording medium conveying direction of the line scanner 21, and includes the platen 23 in the position opposed to the thermal head 22 as the heating device across the recording medium conveying path. The erasing device 17 causes the heat generating elements 32 of the thermal head 22 in positions corresponding to the color and density sensors 31 in positions of colors detected by the line scanner 21 to generate heat. Therefore, there is an effect that only small amount of energy is required for erasing.

The erasing device 17 controls, according to detected colors or density, a quantity of heat to be generated. Therefore, there is an effect that only smaller amount of energy is required for erasing.

While certain embodiments have been described, these embodiments have been presented by way of example only, and are not intended to limit the scope of the inventions. Indeed, the novel methods, devices, and apparatuses described herein may be embodied in a variety of other forms; furthermore, various omissions, substitutions and changes in the form of the methods and systems described herein may be made without departing from the spirit of the inventions. The accompanying claims and their equivalents are indeed to cover such forms or modifications as would fall within the scope and spirit of the inventions.

What is claimed is:

1. An erasing device configured to erase an image formed on a recording medium, the erasing device comprising:

a line scanner configured to read an image formed on a recording medium conveyed thereto;

a thermal head set downstream in a recording medium conveying direction of the line scanner and on a same side as the line scanner with respect to a conveying path for the recording medium and including plural heat generating elements; and an erasing-device control section configured to change, according to an output of the line scanner, positions of the heat generating elements to be caused to generate heat and a quantity of heat of each of the heat generating elements.

2. The device according to claim 1, wherein
the line scanner includes plural full-color sensors, and
the erasing-device control section changes, according to positions and colors of an image detected by the line scanner, positions of the heat generating elements to be caused to generate heat and a quantity of heat of each of the heat generating elements.

3. The device according to claim 1, wherein
the line scanner includes plural density sensors, and
the erasing-device control section changes, according to positions and density of an image detected by the line scanner, positions of the heat generating elements to be caused to generate heat and a quantity of heat of each of the heat generating elements.

4. The device according to claim 1, further comprising:
a rear-side line scanner set on an opposite side of the line scanner with respect to the conveying path for the recording medium; and
a rear-side thermal head set downstream in the recording medium conveying direction of the rear-side line scanner and on a same side as the rear-side line scanner with respect to the conveying path for the recording medium and including plural heat generating elements, wherein
the erasing-device control section changes, according to an output of the line scanner, positions of the heat generating elements of the thermal head to be caused to generate heat and a quantity of heat of each of the heat generating elements and changes, according to an output of the rear-side line scanner, positions of the heat generating elements of the rear-side thermal head to be caused to generate heat and a quantity of heat of each of the heat generating elements.

5. The device according to claim 1, wherein the erasing-device control section includes:
a point erasing section configured to change, according to an output of the line scanner, positions of the heat generating elements to be caused to generate heat and a quantity of heat of each of the heat generating elements; and
a full-screen erasing section configured to cause all the heat generating elements to generate heat.

6. An image forming apparatus including an erasing device, the image forming apparatus comprising:
an electrostatic-latent-image bearing member configured to bear an electrostatic latent image;
a developing-agent supplying unit configured to supply a developing agent to the electrostatic latent image;
an image bearing member configured to bear a developing agent image;
a fixing device configured to fix the developing agent image on a recording medium; and
an erasing device including:
a line scanner configured to read an image formed on a recording medium conveyed thereto;
a thermal head set downstream in a recording medium conveying direction of the line scanner and on a same side as the line scanner with respect to a conveying path for the recording medium and including plural heat generating elements; and
an erasing-device control section configured to change, according to an output of the line scanner, positions of the heat generating elements to be caused to generate heat and a quantity of heat of each of the heat generating elements.

7. The apparatus according to claim 6, wherein
the line scanner includes plural full-color sensors, and
the erasing-device control section changes, according to positions and colors of an image detected by the line scanner, positions of the heat generating elements to be caused to generate heat and a quantity of heat of each of the heat generating elements.

8. The apparatus according to claim 6, wherein
the line scanner includes plural density sensors, and
the erasing-device control section changes, according to positions and density of an image detected by the line scanner, positions of the heat generating elements to be caused to generate heat and a quantity of heat of each of the heat generating elements.

9. The apparatus according to claim 6, further comprising:
a rear-side line scanner set on an opposite side of the line scanner with respect to the conveying path for the recording medium; and
a rear-side thermal head set downstream in the recording medium conveying direction of the rear-side line scanner and on a same side as the rear-side line scanner with respect to the conveying path for the recording medium and including plural heat generating elements, wherein
the erasing-device control section changes, according to an output of the line scanner, positions of the heat generating elements of the thermal head to be caused to generate heat and a quantity of heat of each of the heat generating elements and changes, according to an output of the rear-side line scanner, positions of the heat generating elements of the rear-side thermal head to be caused to generate heat and a quantity of heat of each of the heat generating elements.

10. The apparatus according to claim 6, wherein the erasing-device control section includes:
a point erasing section configured to change, according to an output of the line scanner, positions of the heat generating elements to be caused to generate heat and a quantity of heat of each of the heat generating elements; and
a full-screen erasing section configured to cause all the heat generating elements to generate heat.

11. The apparatus according to claim 6, wherein the erasing device is set upstream in the recording medium conveying direction of the fixing device.

12. An image erasing device configured to erase an image on a recording medium, the image erasing device comprising:
a recording-medium accumulating section configured to accumulate recording media;
a recording-medium conveying mechanism configured to extract the recording media from the recording-medium accumulating section one by one and convey the recording medium; and
an erasing device including:
a line scanner configured to read an image formed on a recording medium conveyed thereto;
a thermal head set downstream in a recording medium conveying direction of the line scanner and on a same side as the line scanner with respect to a conveying path for the recording medium and including plural heat generating elements; and
an erasing-device control section configured to change, according to an output of the line scanner, positions of the heat generating elements to be caused to generate heat and a quantity of heat of each of the heat generating elements.

13. The device according to claim 12, wherein the line scanner includes plural full-color sensors, and the erasing-device control section changes, according to positions and colors of an image detected by the line scanner, positions of the heat generating elements to be caused to generate heat and a quantity of heat of each of the heat generating elements.

14. The device according to claim 12, wherein the line scanner includes plural density sensors, and the erasing-device control section changes, according to positions and density of an image detected by the line scanner, positions of the heat generating elements to be caused to generate heat and a quantity of heat of each of the heat generating elements.

15. The device according to claim 12, further comprising:

a rear-side line scanner set on an opposite side of the line scanner with respect to the conveying path for the recording medium; and a rear-side thermal head set downstream in the recording medium conveying direction of the rear-side line scanner and on a same side as the rear-side line scanner with respect to the conveying path for the recording medium and including plural heat generating elements, wherein the erasing-device control section changes, according to an output of the line scanner, positions of the heat generating elements of the thermal head to be caused to generate heat and a quantity of heat of each of the heat generating elements and changes, according to an output of the rear-side line scanner, positions of the heat generating elements of the rear-side thermal head to be caused to generate heat and a quantity of heat of each of the heat generating elements.

16. The device according to claim 12, wherein the erasing-device control section includes:

a point erasing section configured to change, according to an output of the line scanner, positions of the heat generating elements to be caused to generate heat and a quantity of heat of each of the heat generating elements; and a full-screen erasing section configured to cause all the heat generating elements to generate heat.

17. An erasing method for an erasing device configured to erase an image on a recording medium, the method comprising:

a line scanner reading an image formed on a recording medium conveyed thereto; and an erasing-device control section changing, according to an output of the line scanner, positions of heat generating elements of a thermal head to be caused to generate heat and a quantity of heat of each of the heat generating elements, the thermal head being set downstream in a recording medium conveying direction of the line scanner and on a same side as the line scanner with respect to a conveying path for the recording medium and including plural heat generating elements.

18. The method according to claim 17, wherein the erasing-device control section changes, according to positions and colors of an image detected by the line scanner, positions of the heat generating elements to be caused to generate heat and a quantity of heat of each of the heat generating elements.

19. The method according to claim 17, wherein the erasing-device control section changes, according to positions and density of an image detected by the line scanner, positions of the heat generating elements to be caused to generate heat and a quantity of heat of each of the heat generating elements.

20. The method according to claim 17, wherein the erasing-device control section changes, according to an output of the line scanner, positions of the heat generating elements of the thermal head to be caused to generate heat and a quantity of heat of each of the heat generating elements and changes, according to an output of a rear-side line scanner, positions of the heat generating elements of a rear-side thermal head to be caused to generate heat and a quantity of heat of each of the heat generating elements.

* * * * *